US007896540B2

(12) United States Patent
Lowan et al.

(10) Patent No.: US 7,896,540 B2
(45) Date of Patent: Mar. 1, 2011

(54) AUTOMATED CLAMPING CONTROL MECHANISM AND CLAMPING METHOD FOR FLUID MIXERS

(75) Inventors: Margaret M. Lowan, Rolling Meadows, IL (US); Steven Page, Palatine, IL (US)

(73) Assignee: Fluid Management Operations, LLC, Wheeling, IL (US)

( * ) Notice: Subject to any disclaimer, the term of this patent is extended or adjusted under 35 U.S.C. 154(b) by 1144 days.

(21) Appl. No.: 11/372,306

(22) Filed: Mar. 9, 2006

(65) Prior Publication Data

US 2007/0211568 A1 Sep. 13, 2007

(51) Int. Cl.
*B01F 11/00* (2006.01)

(52) U.S. Cl. ..... 366/209; 366/601; 366/605

(58) Field of Classification Search ..... 366/110–12, 366/209, 211, 601, 605
See application file for complete search history.

(56) References Cited

U.S. PATENT DOCUMENTS

| | | | | |
|---|---|---|---|---|
| 4,134,689 | A * | 1/1979 | Ahrenskou-Sorensen | 366/110 |
| 4,842,415 | A * | 6/1989 | Cane et al. | 366/110 |
| 5,066,136 | A * | 11/1991 | Johnson | 366/209 |
| 5,268,620 | A | 12/1993 | Hellenberg | |
| 6,850,020 | B1 | 2/2005 | Midas et al. | |
| 2004/0013031 | A1 * | 1/2004 | Salas et al. | 366/141 |

FOREIGN PATENT DOCUMENTS

WO WO 2006006025 1/2006

OTHER PUBLICATIONS

International Searching Authority, "International Search Report and Written Opinion" Jul. 26, 2007, 15 Pages.
International Preliminary Report from counterpart application No. PCT/US2007/063459; Report dated Sep. 9, 2009.

* cited by examiner

*Primary Examiner*—David L Sorkin
(74) *Attorney, Agent, or Firm*—Miller, Matthias & Hull LLP

(57) ABSTRACT

Disclosed herein is a system and method for adequately securing the currently available metal and plastic containers for paint and other fluids as well as other foreseeable containers in an automated fashion without crushing or damaging the containers, without using any special adapters for particular container types and without operator intervention. To avoid crushing a plastic container, the disclosed system and method takes advantage of the compressibility of these less rigid plastic containers. It has been found that a plastic paint container can be safely clamped in place without structural damage if the clamp plate travel after engagement with the top of the container is limited to a certain value, for example, about 5/16". When the compression amount if limited or controlled, the plastic container will not move or will move very little during a three minute violent shake cycle. Some conventional containers are not readily compressible, such a metal cans, drums or the larger (five gal.) plastic buckets or pails. To address the issue of these containers being used with the same machine as the new plastic containers, an increase in current or voltage drawn by the clamping motor is monitored after initial contact with the top(s) of the container(s), and if the increase reaches a threshold value, the motion of the upper clamping plate is stopped and an appropriate holding force is maintained.

17 Claims, 5 Drawing Sheets

17
CONTROLLER
50
102
19
74
25
20
100
24
42
52
22
101
27
27
48
46
15
49
23
23
19
26
27
21
31
27
34
36
32
64
22
60a
62
56
21
22
60b

FIG. 4
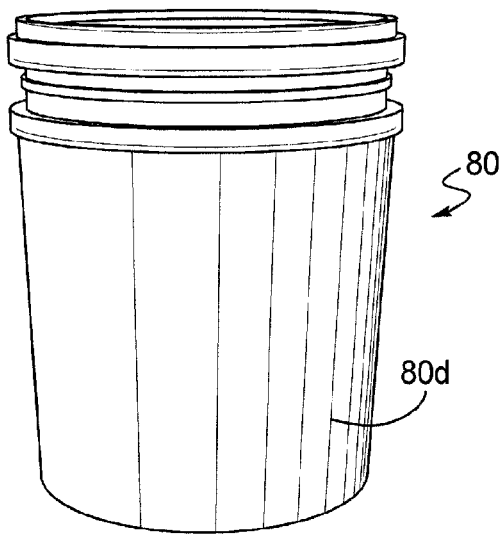
FIG. 5
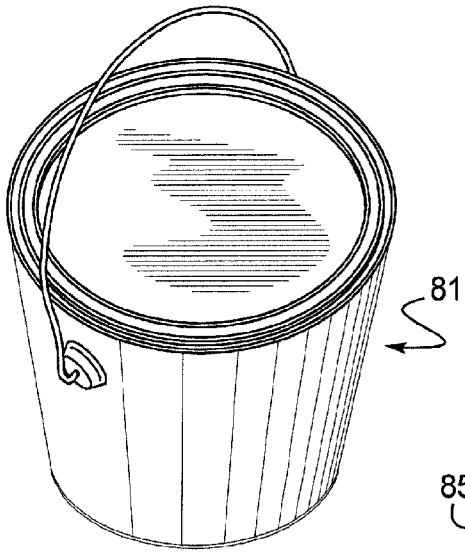
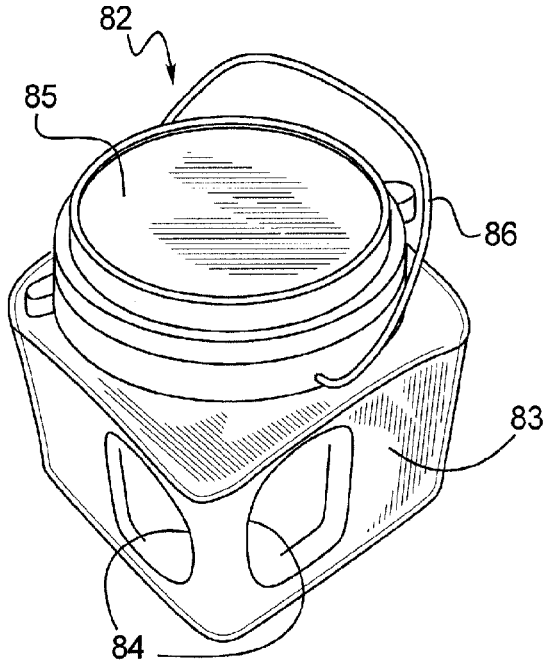
FIG. 6

AUTOMATED CLAMPING CONTROL MECHANISM AND CLAMPING METHOD FOR FLUID MIXERS

BACKGROUND

1. Technical Field

A fluid mixer is disclosed wherein the clamping force imposed on the container or containers loaded into the mixer is determined by one of two events that can occur after the upper clamping plate engages the top(s) of the container(s) disposed on the lower clamping plate: (1) if the motor current increases above a predetermined level, the container(s) are automatically determined to be of the non-compressible type, the motor is stopped and the mixing operation can begin; or (2) if the system senses a continued downward travel of the upper plate after initial contact with the container(s) of a predetermined distance, the container(s) is determined to be compressible (e.g. plastic), the motor is stopped and the mixing operation can begin.

2. Description of the Related Art

Many types of fluids need to be mixed or blended into homogenous mixtures in the same containers in which they are sold to a consumer. One example of such in-container mixing results from colorants or pigments being added to base paints at a retail paint store or paint department of a home improvement store. The mixers or mixing machines may operate by vibration, roto-vibration, gyroscopic motion or rotational motion. The forces exerted on the containers during the mixing process are violent.

To ensure that the container or containers stay in position during the violent mixing operation, various clamping mechanisms have been employed. Until recently, the amount of clamping force imposed on a conventional metal cylindrical container (e.g., 1 gal.) or plastic cylindrical container (e.g., 5 gal.) was not crucial as the containers were extremely rugged, and therefore it is difficult to damage a conventional container by over-clamping.

However, paint has become available in rectangular and cubical plastic containers which are not as robust as the conventional cylindrical containers. Further, there is a need to blend or custom mix colors of paint in the new rectangular containers. One rectangular paint container has a handle molded into one corner for the painter's convenience in pouring paint from the container. Such a rectangular paint container has a rectangular or square footprint or cross section. Another new type of container includes rectangular trays or trough-like buckets sized to receive a paint roller. Some of the rectangular trays or troughs may be pre-equipped with a screen or insert for engaging the roller. Smaller plastic cylindrical containers are also being used instead of the traditional metal cylindrical containers.

The new types of containers are fabricated from plastic and are less robust than the conventional counterparts. Hence, an automatic clamping mechanism of a prior mixing machine is capable of crushing most, if not all, of the new types of containers. To avoid the problem of containers being crushed by the mixing machines and the spillage of paint, new and improved clamping mechanisms and automated clamping mechanisms are needed. Further, such clamping mechanisms must be versatile and capable of use on the various types of containers in the marketplace, both old and new.

SUMMARY OF THE DISCLOSURE

In order to address the problem of applying the correct clamping pressure without crushing or damaging the container, an improved clamping mechanism and method for clamping containers securely within a mixing apparatus are disclosed.

One disclosed method for clamping one or more containers in a fluid mixing apparatus comprises: placing one or more containers on a lower base; lowering an upper plate towards the containers using a motor; detecting when the upper plate engages the one or more containers; measuring any additional downward movement of the upper plate and measuring any increase in current or voltage drawn by the motor, and carrying out at least one of the following two steps:

- if the additional downward movement reaches a first predetermined value, reducing a motor speed to maintain a holding pressure,
- if the current or voltage draw reaches a second predetermined value, reducing the motor speed to maintain a holding pressure.

In a refinement, the lowering of the upper plate is carried out at a first higher motor speed, and the measuring of any additional downward movement of the upper plate and the measuring any increase in current or voltage drawn by the motor are carried out at a second reduced motor speed.

In a refinement, the method further comprises moving the upper plate past a home sensor to detect a home position prior to detecting when the upper plate engages the one or more containers.

In a refinement, multiple containers are placed on the lower base, the containers each having a common height.

In a refinement, the one or more containers are selected from the group consisting of five gallon cylindrical plastic pails, five gallon cylindrical metal pails, one gallon cylindrical metal pails, one gallon cylindrical plastic pails, one gallon cylindrical combination plastic/metal pails, one gallon cubically shaped plastic container with a round lid and integrated handle, one and one-half gallon cubically shaped plastic container with a round lid and integrated handle, one and one-half gallon rectangular plastic trough with rectangular lid, one gallon rectangular plastic trough with rectangular lid, one quart cylindrical metal pails, one quart cylindrical plastic pails, one quart cylindrical combination plastic/metal pails, one quart cubically shaped plastic container with a round lid and integrated handle, one quart rectangular plastic trough with rectangular lid, one pint cylindrical metal pails, one pint cylindrical plastic pails, one pint cylindrical combination plastic/metal pails, one pint cubically shaped plastic container with a round lid and integrated handle, and one pint rectangular plastic trough with rectangular lid.

In a refinement, the holding pressure increases as a spacing between the lower base and upper plate increases.

In a refinement, the holding pressure varies as a spacing between the lower base and upper plate varies.

In a refinement, the holding pressure is different when the additional downward movement reaches a first predetermined value than when the current or voltage draw reaches a second predetermined value.

In a refinement, the holding pressure is greater when the current or voltage draw reaches a second predetermined value than when the additional downward movement reaches a first predetermined value.

Another disclosed method for clamping one or more containers in place in a fluid mixing apparatus prior to carrying out a mixing operation comprises: placing one or more containers on a lower base; lowering an upper plate towards the containers using a motor controlled by a controller; sensing when the upper plate engages the one or more containers and sending a first signal to the controller; reducing the motor speed after the first signal is received by the controller; after the motor speed is reduced, measuring any additional downward movement of the upper plate and measuring any increase in current or voltage drawn by the motor; and if the additional downward movement reaches a first predetermined value, reducing the motor speed again to maintain a holding pressure, or if the current or voltage draw reaches a second predetermined value, adjusting the motor speed to maintain a holding pressure.

A disclosed fluid mixer comprises: a clamping mechanism comprising a lower base and an upper plate; the upper plate being movable towards or away from the lower base by a motor; the motor being controlled by a controller, the motor comprising a shaft sensor associated with a motor shaft and at least one of a current draw or voltage draw sensor, the shaft sensor and current or voltage draw sensor both being linked to the controller, the upper plate comprising a plate sensor for sensing when the upper plate engages a container disposed on the lower base, the plate sensor being linked to the controller; the controller having a memory, the memory being programmed to reduce the motor speed to a holding pressure level if the shaft sensor sends a signal to the controller indicating that additional downward movement of the upper plate has occurred that reaches a first threshold value after the upper plate has engaged the container, and reduce the motor speed to the holding pressure level if an increase in current or voltage drawn by the motor is detected by the controller and reaches a second threshold value.

In a refinement, the controller is also programmed to reduce the motor speed after a signal is received by the controller from the plate sensor indicating the upper plate has engaged a container disposed on the lower base.

In a refinement, the holding pressure imposed after the first threshold value is reached is less than if the second threshold value is reached.

Thus, disclosed herein is a system and method for adequately securing the currently available metal and plastic containers for paint and other fluids as well as other foreseeable containers in an automated fashion without crushing or damaging the containers, without using any special adapters for particular container types and without operator intervention.

Currently, paint containers are available in two general types. First, the traditional, cylindrical, quart, gallon and five gallon containers are known to be in construction and can withstand a high clamping force. Crushing of these types of containers is not normally an issue for a mixer that is operating properly. The second broad category includes newer plastic quart, gallon and a variety of containers that can be used with paint rollers. These containers are less rigid and can be damaged or caused to leak by a high clamping force required to hold the heavier conventional five gallon bucket containers in place.

To avoid crushing a plastic container, the disclosed system and method takes advantage of the compressibility of these less rigid plastic containers. It has been found that plastic containers can be compressed without structural damage if the compression amount or compression distance is limited to a predetermined value or range. By way of example only, it has been found that a plastic paint container can be safely clamped in place without structural damage if the clamp plate travel after engagement with the top of the container is limited to a certain value, for example, about 5/16" (~0.3125" or ~7.94 mm). When the compression amount if limited or controlled, the container will not move or will move very little during a three minute violent shake cycle. Also the clamping force causing such a controlled compression of the container would not cause permanent damage or leaks.

Preferably, but not essentially, a predetermined compression distance can be used for all of the current types of plastic containers including cubical with built-in handle, rectangular trough with built-in screen for use with roller, rectangular trough-type and one gallon plastic cylindrical. The same value can also be used regardless of how many containers were in the clamping mechanism. For example, four of the cubical plastic containers with built-in handles can fit on many mixer platforms. However, one restriction is that multiple containers must be the same height for an accurate compression distance to be measured.

Preferably, the compression distance upper limit is set to about 0.3125 in., less preferably to about 0.32 in. A compression distance range can also be set from about 0.30 to about 0.32 in. These values are not intended to be a limit on the scope of this disclosure as new containers will come on to the market made from a variety of polymer materials. Thus, testing and calibration of mixing apparatuses needs to be continued.

Of course, some conventional containers are not readily compressible, such a metal cans, drums or the larger (five gal.) plastic buckets or pails. To address the issue of these containers being used with the same machine as the new plastic containers, a second limit on clamping force is needed. In the disclosed system and method, an increase in current or voltage drawn by the clamping motor is monitored after initial contact with the top(s) of the container(s), and if the increase reaches a threshold value, the motion of the upper clamping plate is stopped.

As an exemplary embodiment, the upper clamp plate moves up and down along two lead screws. As an option, the upper plate may include a downward facing lip on its front edge to prevent containers falling out in a forward fashion. A sensor mechanism on the upper clamp plate detects when the clamp comes into contact with the container or containers being clamped. Again, the mixing of multiple containers is possible, depending upon mixer size and container size.

The fixed lower base of the clamp may also have an upward facing lip on its rear edge to prevent containers falling out in a rearward fashion. The lead screws are rotated by a motor, preferably by a DC motor. The speed (rpm) and direction is controlled by a controller or one or more control circuit boards. A sensor on the motor shaft preferably sends a pulse to the controller every revolution of the motor. By way of example, one revolution of the motor may be equivalent to a fraction of a revolution (e.g., $1/25^{th}$) of the lead screw thereby producing a short movement of the upper clamp plate (e.g., 0394") and enabling accurate monitoring of the upper plate movement.

The motor current is measured by the controller. Voltage may also be measure or monitored instead of or in addition to motor current. The current is related to the torque exerted by the motor and hence to the pressure exerted by the clamp on the container(s).

A home sensor detects the position of the upper plate and acts as a reference which together with the sensor on the motor shaft allows the controller to calculate where the upper plate is at all times.

In operation, the upper plate is raised (if necessary) to load the container(s). The operator will close the door, select a mix time and press a start switch. The upper plate will be lowered by the motor at full or high speed. A sensor on the clamp plate will send a signal to the controller when it hits the top of the container(s). At this point, the power supplied to the motor will be reduced to slow the motor.

The motor will be operated at reduced power until either of two things happen. (1) The upper plate travels a predetermined distance below the point of contact with the top(s) of the container(s) or (2) the motor current or voltage increases above a predetermined level related to the maximum required clamp pressure of an incompressible (conventional) container. Power supplied to the motor is then further reduced to a holding level sufficient to maintain whatever pressure the clamp is exerting but without driving the clamp further down. At this point, the shake motor is activated for the duration of the selected mix time. When the mix time has elapsed, the shake motor is switched off and, after a slow down time, the clamp plate is raised and the door lock released so the operator can remove the container(s).

Additional refinements may include adjustments to the compression distance and holding current or voltage level depending on the height of the upper plate (i.e. height of the container(s)). Another refinement may include adjusting the holding power according to whether (1) or (2) occurred above.

Other advantages and features will be apparent from the following detailed description when read in conjunction with the attached drawings.

BRIEF DESCRIPTION OF THE DRAWINGS

For a more complete understanding of the disclosed methods and apparatuses, reference should be made to the embodiment illustrated in greater detail on the accompanying drawings, wherein:

FIG. 4 is a front perspective view of a typical five gallon bucket that can be accommodated by the disclosed mixing machine;

FIG. 5 is a top perspective view of a typical one gallon, one quart, one and one half gallon or one pint cylindrical metal, plastic or combination metal/plastic container that can be accommodated by the disclosed mixing machine;

FIG. 6 is a top perspective view of a typical square or rectangular plastic container with a built-in handle that can be accommodated by the disclosed mixing machine and that may be provided in a variety of sizes;

It should be understood that the drawings are not necessarily to scale and that the disclosed embodiments are sometimes illustrated diagrammatically and in partial views. In certain instances, details which are not necessary for an understanding of the disclosed methods and apparatuses or which render other details difficult to perceive may have been omitted. It should be understood, of course, that this disclosure is not limited to the particular embodiments illustrated herein.

DETAILED DESCRIPTION OF THE PRESENTLY PREFERRED EMBODIMENTS

Figure 1:
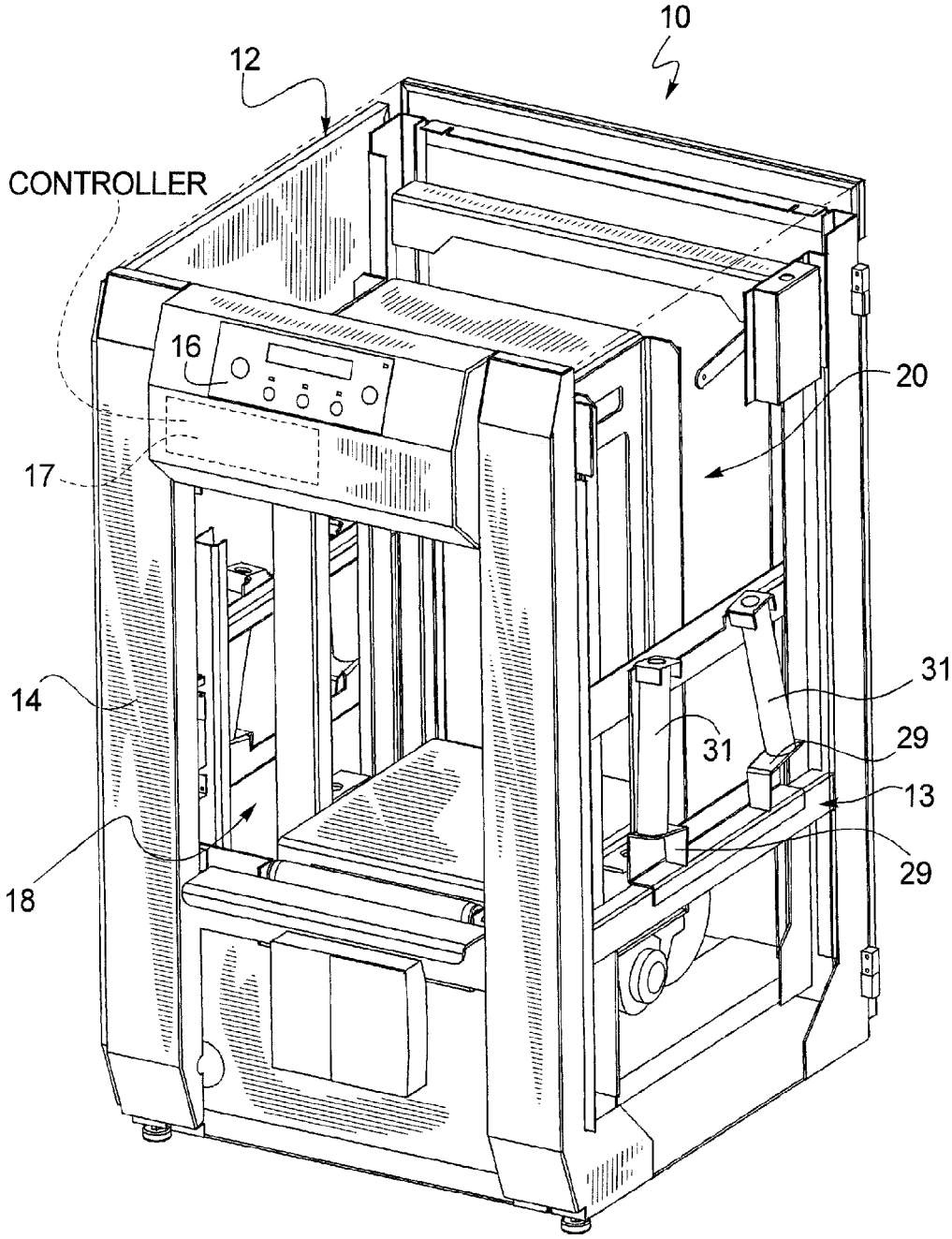
FIG. 1 is a perspective view of a mixing machine made in accordance with this disclosure.

Referring first to FIG. 1, a mixing apparatus 10 is shown having an outer enclosure 12. The outer enclosure 12 includes a front panel 14 having a controls area 16 in which may be provided input devices (such as switches and knobs) and output devices (such as a timer) for controlling and monitoring operation of the mixer. A controller is shown at 17 for controlling the clamping mechanism 19 shown in FIGS. 2 and 3. The front panel 14 also includes an access window or door 18 through which a user may access an interior of the enclosure 12.

Figure 2:
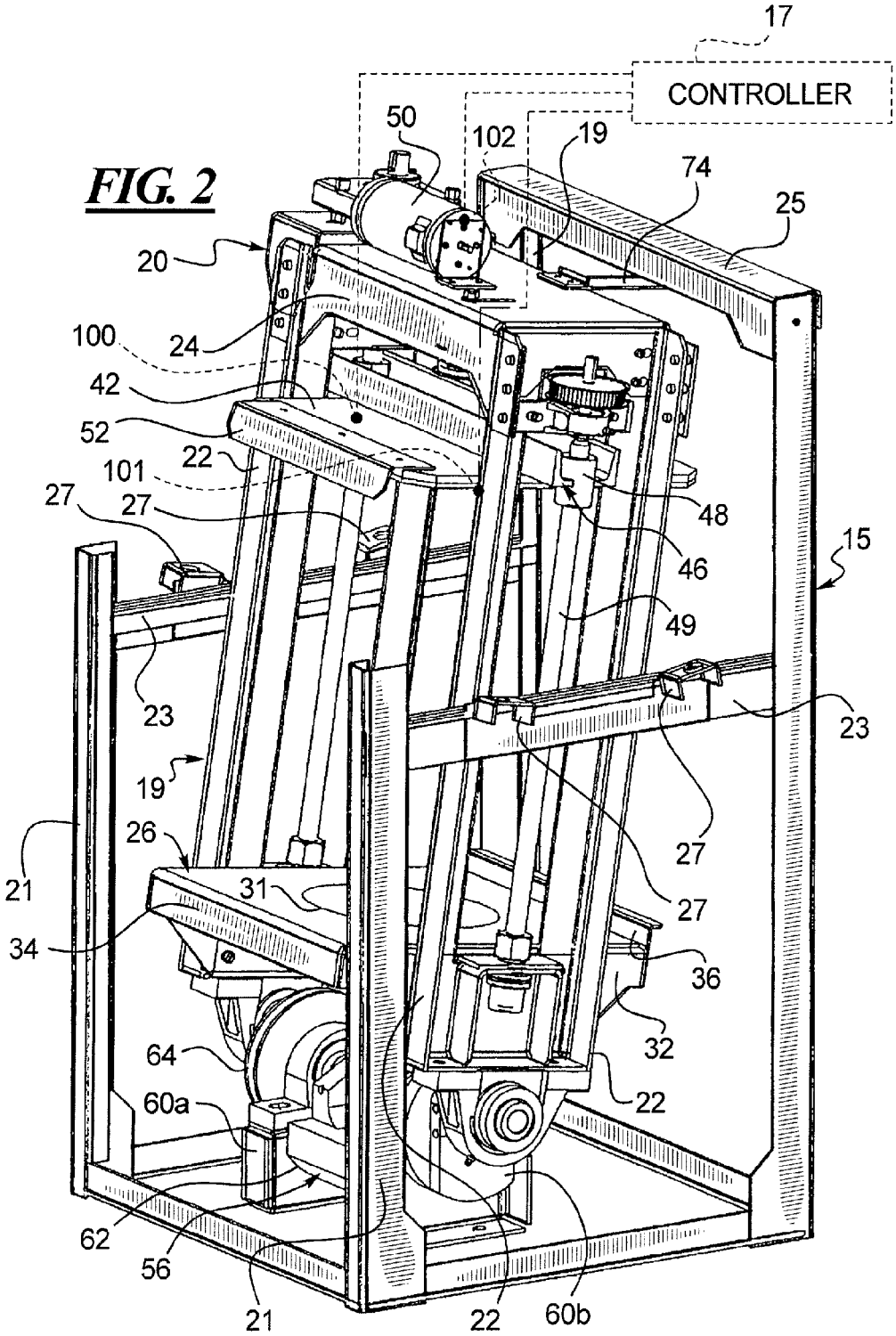
FIG. 2 is a right front perspective view of the internal shaker frame of the shaker-type mixing machine of FIG. 1.

An agitator frame assembly 20 is disposed inside the enclosure 12 for securing a container and for generating a reciprocating force that agitates the container and its contents. As best illustrated in FIG. 2, the agitator frame assembly 20 includes spaced first and second side supports 22, the top ends of which are connected by a cross member 24.

A stationary lower base 26 is attached to and extends between bottom portions of the side supports 22. The lower base assembly 26 also includes two side panels 32, a front wall 34, and a rear wall 36 depending therefrom.

An upper plate assembly 42 is disposed above the lower base 26 and is movable in a vertical direction to adjust the spacing between the lower base 26 and upper plate 42, to thereby accommodate containers of various sizes and to exert the desired clamping force on the container lid. As best shown in FIG. 2, the upper plate 42 includes having a generally rectangular shape and a u-shaped cross beam 46 is attached to a top surface of the plate 42. A threaded coupling 48 is attached to each end of the u-shaped cross beam 46 and is sized to receive a threaded rod 49. A motor 50 is operably coupled to the threaded rods 49 by way of a pulley mechanism for rotating the rods 49 in either the clockwise or counterclockwise direction, thereby raising or lowering the upper plate 42 with respect to the lower base 26. The upper plate 42 may also include a front lip 52 attached to the plate 42.

The lower base 26 and upper plate assembly 42 form an adjustable clamp for securely holding containers during operation of the mixer 10. A clamping area is defined between the lower base 26 and upper plate 42. Accordingly, a height of the clamping area will vary with the position of the upper clamp member 42 with respect to the clamp base 26, thereby allowing the adjustable clamp to accommodate containers of various heights. In addition, the open frame construction of the agitator frame assembly 20 accommodates various container sizes and shapes.

Figure 3:
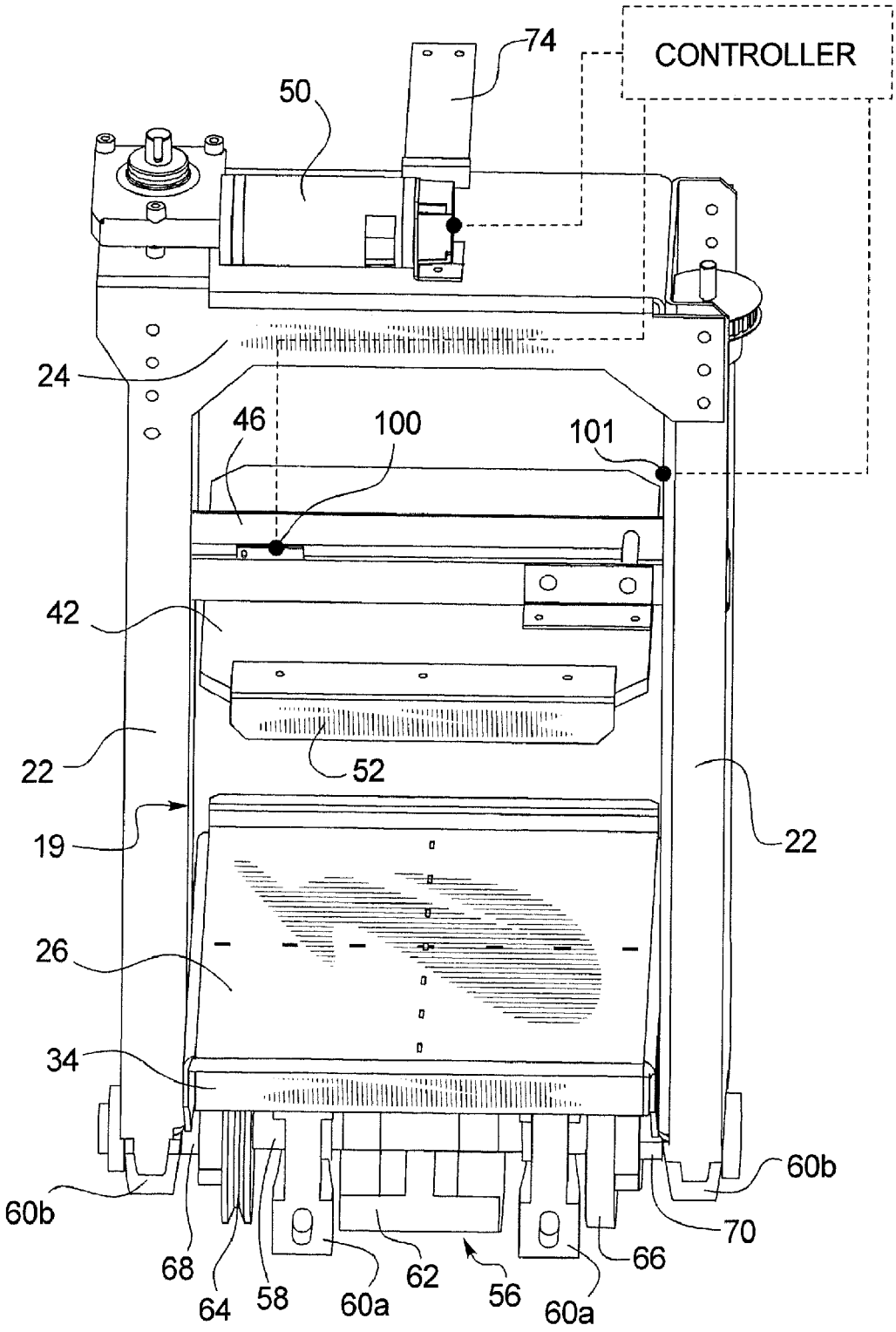
FIG. 3 is a front perspective view of the internal shaker frame of the shaker-type mixing machine of FIGS. 1 and 2.

An eccentric drive 56 is coupled to a bottom of the agitator frame assembly 20 for driving the frame assembly 20 in a reciprocating motion. As illustrated in FIGS. 2 and 3, the eccentric drive 56 includes a drive shaft 58 supported for rotation by two inner bearings 60*a* and a pair of stub shafts 68, 70 supported by the outer bearings 60*b*. The outer bearings 60*b* may be pillow block bearings that are coupled to the stationary outer enclosure 12. A counterweight 62 is coupled to the drive shaft 58. A pulley 64 is attached to one end of the drive shaft 58 adapted to be rotatably driven, such as be a belt coupled to a motor (not shown). A coupling 66 is coupled to the end of the drive shaft 58 opposite the pulley 64. The stub shafts 68, 70 are coupled to the pulley 64 and coupling 66, respectively. The stub shafts 68, 70 are aligned to have substantially the same axis, but are offset from an axis of the drive shaft 58, so that the stub shafts 68, 70 are eccentrically mounted with respect to the drive shaft 58. Outer ends of the stub shafts 68, 70 are rotatably received by the pillow block bearings 60*b*, coupled to the bottom ends of the side supports 22. As a result, rotation of the drive shaft 58 causes the stub shafts 68, 70 to revolve about an axis of the drive shaft 58, thereby driving the frame assembly 20 in a reciprocating motion. The maximum displacement, or stroke, of the eccentric drive is determined by the distance between the drive shaft axis and the stub shaft axis.

The top of the agitator frame assembly 20 is secured to the outer enclosure 12 by a flexible link. For example, a slat 74 may have a first end attached to the cross member 24 (FIG. 2) and a second end coupled to the enclosure 12. The slat 74 may be flexible to act like a leaf spring, thereby to accommodate movement of the frame assembly 20 during operation of the mixer 10. Accordingly, the bottom end of the frame assembly 20 is secured to the enclosure 12 by the bearings 60 which receive the drive axis 58 and the top end of the frame assembly 20 is secured to the enclosure 12 by the slat 74, thereby maintaining the frame assembly 20 in an upright orientation.

A sensor 100 is disposed or associated with the upper plate 42 for detecting when the upper plate 42 makes contact with a top of a container disposed on the lower base 26. A home sensor 101 is used to keep track of the position of the upper plate 42 and the distance traveled by the upper plate 42. Both sensors 101, 102 are linked to the controller 17 or control circuit board.

The problem addressed herein is how to use an automated clamping system for the mixer 10 with the variety of currently available containers shown in FIGS. 4-8. Turning to FIGS. 4-8, five different fluid containers, in particular paint containers, are illustrated which are in current use or will be used in the near future.

FIG. 4 illustrates a five gallon plastic pail 80 that is sturdy or robust enough to withstand clamping forces by currently available mixer designs, such as that shown at 10 in FIGS. 1-3. The pail 80 may also be fabricated from metal. Because of the sturdiness of this container 80, clamping pressure is not normally an issue. Turning to FIG. 5, a typical metal cylindrical pail 81 is disclosed but the pail 81 can be fabricated from plastic or a combination of plastic and metal as well. The vertical walls and top provide a sturdy construction. The typical volume is one gallon, but one and one-half gallon, one quart and one pint sizes are available and can be used with the disclosed apparatus. Like the five gallon container 80 shown in FIG. 4, the pail 81 is sturdy and over-lamping or crushing for a conventional clamping apparatus is normally not a problem. The clamping pressure for a plastic or plastic/metal embodiment of the pail 81 may need to be less than that for a metal pail 81.

Turning to FIG. 6, a new plastic container 82 is disclosed that has a generally cubical body 83 with a built-in handle shown at 84. The plastic container 82 includes a plastic round top 85 and a bail 86. The container 82, because of its plastic and lightweight construction, is not as strong or robust as the containers shown at 80, 81 in FIGS. 4 and 5, respectively. Therefore, any clamping pressure applied to the container 82 must be substantially less than that applied to the containers 80, 81. Further, because of its plastic construction, the structure of the container 82 can be somewhat compressed by a clamping mechanism. One way to control clamping pressure will be to allow only a certain and limited amount of downward travel of the upper plate 42 after the upper plate 42 engages the top 85 of the container 82. This strategy will be discussed in greater detail below. Other strategies would be to limit the amount of clamping force imposed by the upper plate 42 on the container 82, limiting the current increase experienced by the motor 50 after the upper plate 42 engages the top 85 of the container 82 or simply measuring clamping or holding pressure and limiting the value of the pressure or force imposed on the container 82.

Figure 7:
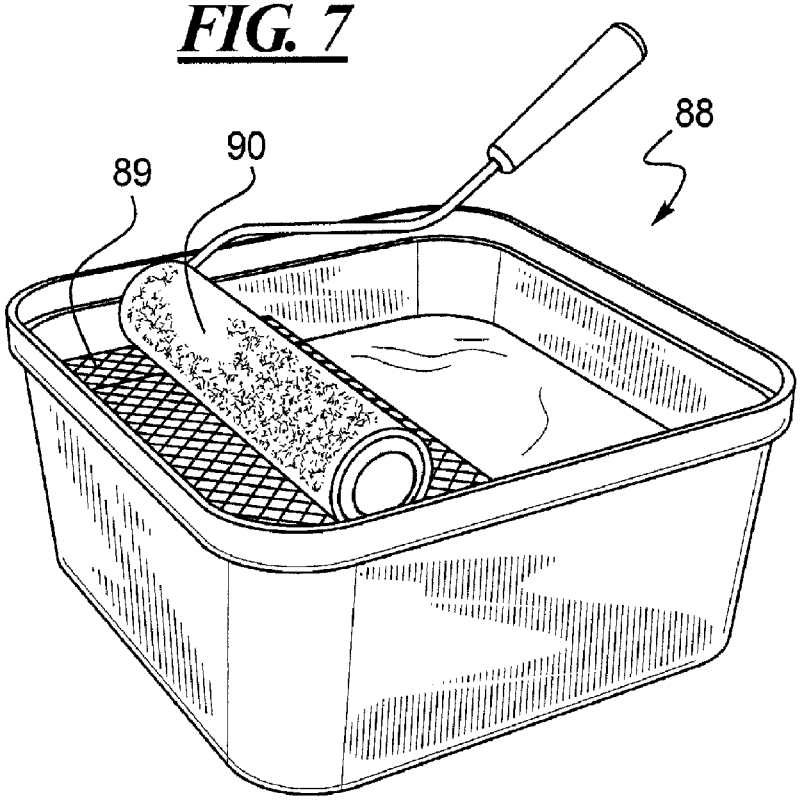
FIG. 7 is a top perspective view of a typical rectangular plastic container equipped to receive a roller that can be accommodated by the disclosed mixing machine and that may be provided in a variety of sizes.

Similar strategies would need to be employed for the rectangular container 88 shown in FIG. 7 which has a rectangular body with a built-in screen or mesh 89 for receiving a roller shown at 90. The container 88 includes a rectangular top and is typically made of plastic. Hence, the container 88 could be crushed or ruptured if the same force were imposed on the container 88 as that needed to secure a larger container 80 in place. Thus, the container 88, like the container 82 of FIG. 6, requires reduced clamping force. Similarly, the trough-like container 91 of FIG. 8 may also be fabricated from plastic and would therefore require a reduced clamping force. The containers 82, 88 and 91 come in a variety of sizes: one and one-half gallon, one gallon, one quart, one pint, etc.

Figure 8:
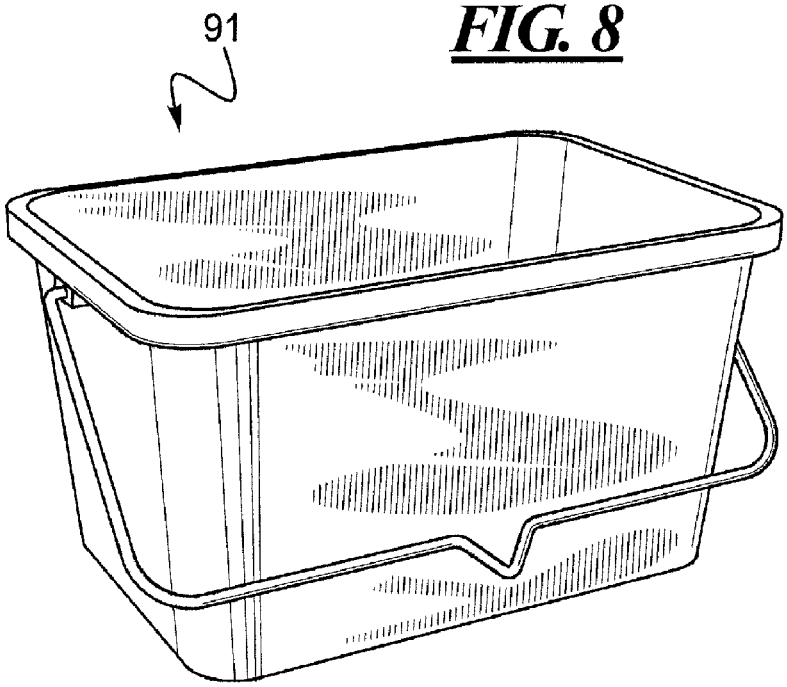
FIG. 8 is a top perspective view of a typical trough-type plastic container that can be accommodated by the disclosed mixing machine and that may be provided in a variety of sizes.

Thus, paint containers are available in two general types. First, the traditional, cylindrical, quart, gallon and five gallon containers are known to be in construction and can withstand a high clamping force. These containers are shown at 80 and 81 in FIGS. 4-5. Crushing of these containers is not normally an issue for a mixer that is operating properly. The second broad category includes newer plastic quart, gallon and a variety of containers that can be used with paint rollers. These containers, shown by way of example at 82, 88 and 91 in FIGS. 6-8 are less rigid and can be damaged or caused to leak by a high clamping force required to hold the heavier conventional five gallon bucket containers in place.

To avoid crushing a plastic container, the disclosed system and method takes advantage of the compressibility of these less rigid plastic containers. It has been found that plastic containers can be compressed without structural damage if the compression amount or compression distance is limited to a predetermined value or range. By way of example only, it has been found that a plastic paint container can be safely clamped in place without structural damage if the clamp plate travel after engagement with the top of the container is limited to a certain value, for example, about 5/16" (~0.3125" or ~7.94 mm). When the compression amount if limited or controlled, the container will not move or will move very little during a three minute violent shake cycle. Also the clamping force causing such a controlled compression of the container would not cause permanent damage or leaks.

Preferably, but not essentially, a predetermined compression distance can be used for all of the current types of plastic containers including cubical with built-in handle 82 (FIG. 6), rectangular trough with built-in screen for use with roller 88 (FIG. 7), rectangular trough-type 91 (FIG. 8) and one gallon plastic cylindrical (see 81 on FIG. 5). The same value can also be used regardless of how many containers were in the clamping mechanism. For example, four of the cubical plastic containers 82 with built-in handles can fit on many mixer platforms. However, one restriction is that multiple containers be of the same height for an accurate compression distance to be measured.

Preferably, the compression distance upper limit is set to about 5/16" or about 0.3125 in. for the currently available plastic containers and anticipated containers, less preferably to about 0.32 in. The value may vary as materials of construction and/or government regulations change. A compression distance range can also be set, for example, from about 0.30 to about 0.32 in. Testing and calibration of mixing apparatuses needs to be continued. This disclosure is intended to cover the concept of applying a clamping force on any plastic container by limiting the compression amount or compression distance of the container to avoid damage or rupture.

Of course, some conventional containers 80, 81 are not readily compressible, such a metal cans, drums or the larger (five gal.) plastic buckets or pails. To address the issue of these containers being used with the same machine as the new plastic containers, a second limit on clamping force is needed. In the disclosed system and method, an increase in current or voltage drawn by the clamping motor 50 is monitored after initial contact with the top(s) of the container(s), and if the increase reaches a threshold value, the motion of the upper clamping plate is stopped.

As an exemplary embodiment, the upper clamp plate 42 moves up and down along two lead screws. As an option, the upper plate 42 may include a downward facing lip 52 on its front edge to prevent containers falling out in a forward fashion. A sensor mechanism 100 on the upper clamp plate detects when the clamp 42 comes into contact with the container or containers being clamped. Again, the mixing of multiple containers is possible, depending upon mixer size and container size.

The fixed lower base 26 may also have an upward facing lip 36 on its rear edge to prevent containers falling out in a rearward fashion. The lead screws 49 are rotated by the motor 50, preferably by a DC motor. The speed (rpm) and direction is controlled by the controller 17 or one or more control circuit boards. A sensor 102 on the motor shaft preferably sends a pulse to the controller every revolution of the motor. By way of example, one revolution of the motor may be equivalent to a fraction of a revolution (e.g., $1/25^{th}$) of the lead screw thereby producing a short movement of the upper clamp plate (e.g., 0394") and enabling accurate monitoring of the upper plate 42 position.

The motor 50 current is measured by the controller 17. Voltage may also be measure or monitored instead of or in addition to motor current. The current is related to the torque exerted by the motor 50 and hence to the pressure exerted by the clamp plates 26, 42 on the container(s).

A home sensor 101 detects the position of the upper plate 42 and acts as a reference which together with the sensor 102 on the motor shaft allows the controller 17 to calculate where the upper plate 42 is at all times.

In operation, the upper plate 42 is raised (if necessary) to load the container(s). The operator will close the door 18, select a mix time and press a start switch. The upper plate 42 will be lowered by the motor 50 at full or high speed. The sensor 100 on the upper clamp plate 42 will send a signal to the controller 17 when the plate engages the top of the container(s). At this point, the power supplied to the motor 50 will be reduced to slow the motor 50.

The motor 50 will be operated at reduced power until either of two things happen: (1) the upper plate 42 travels a predetermined distance (compression distance) below the point of contact with the top(s) of the container(s) or (2) the motor current or voltage increases above a predetermined level related to the maximum required clamp pressure of an incompressible (conventional) container. Power supplied to the motor 50 is then further reduced to a holding level sufficient to maintain whatever pressure the clamp is exerting but without driving the upper plate 42 further downward. At this point, the shake motor (not shown) is activated for the duration of the selected mix time. When the mix time has elapsed, the shake motor is switched off and, after a slow down time, the upper clamp plate 42 is raised and the door lock released so the operator can remove the container(s).

Additional refinements may include adjustments to the compression distance and holding current or voltage level depending on the height of the upper plate (i.e. height of the container(s)). Another refinement may include adjusting the holding power according to whether (1) or (2) occurred above.

Thus, disclosed herein is a system and method for adequately securing the currently available paint containers 80, 81, 82, 88, 91 and others in an automated fashion without crushing or damaging the containers, without using any special adapters and without operator intervention.

While only certain embodiments have been set forth, alternatives and modifications will be apparent from the above description to those skilled in the art. These and other alternatives are considered equivalents and within the spirit and scope of this disclosure and the appended claims.

What is claimed:

1. A method for clamping one or more containers in a fluid mixing apparatus, the method comprising:

(a) placing one or more containers on a lower base, (b) lowering an upper plate towards the containers using a motor, (c) detecting when the upper plate engages the one or more containers, (d) measuring any additional downward movement of the upper plate after detecting when the upper plate engages the one or more containers and measuring any increase in current or voltage drawn by the motor, followed by carrying out at least one of the following two steps:

if the additional downward movement reaches a first predetermined value, reducing a motor speed to maintain a holding pressure, if the current or voltage draw reaches a second predetermined value, reducing the motor speed to maintain a holding pressure.

2. The method of claim 1 wherein the lowering of the upper plate is carried out at a first higher motor speed, and the measuring of any additional downward movement of the upper plate and the measuring any increase in current or voltage drawn by the motor are carried out at a second reduced motor speed.

3. The method of claim 1 further comprising moving the upper plate past a home sensor to detect a home position prior to detecting when the upper plate engages the one or more containers.

4. The method of claim 1 wherein multiple containers are placed on the lower base, the containers each having a common height.

5. The method of claim 4 wherein the one or more containers are selected from the group consisting of five gallon cylindrical plastic pails, five gallon cylindrical metal pails, one gallon cylindrical metal pails, one gallon cylindrical plastic pails, one gallon cylindrical combination plastic/metal pails, one gallon cubically shaped plastic container with a round lid and integrated handle, one and one-half gallon cubically shaped plastic container with a round lid and integrated handle, one and one-half gallon rectangular plastic trough with rectangular lid, one gallon rectangular plastic trough with rectangular lid, one quart cylindrical metal pails, one quart cylindrical plastic pails, one quart cylindrical combination plastic/metal pails, one quart cubically shaped plastic container with a round lid and integrated handle, one quart rectangular plastic trough with rectangular lid, one pint cylindrical metal pails, one pint cylindrical plastic pails, one pint cylindrical combination plastic/metal pails, one pint cubically shaped plastic container with a round lid and integrated handle, and one pint rectangular plastic trough with rectangular lid.

6. The method of claim 1 wherein the holding pressure increases as a spacing between the lower base and upper plate increases.

7. The method of claim 1 wherein the holding pressure varies as a spacing between the lower base and upper plate varies.

8. The method of claim 1 wherein the holding pressure is different when the additional downward movement reaches a first predetermined value than when the current or voltage draw reaches a second predetermined value.

9. The method of claim 1 wherein the holding pressure is greater when the current or voltage draw reaches a second predetermined value than when the additional downward movement reaches a first predetermined value.

10. A method for clamping one or more containers in place in a fluid mixing apparatus prior to carrying out a mixing operation, the method comprising:

(a) placing one or more containers on a lower base, (b) lowering an upper plate towards the containers using a motor controlled by a controller, (c) sensing when the upper plate engages the one or more containers and sending a first signal to the controller, (d) after sensing when the upper plate engages the one or more containers and the first signal is sent to the controller, reducing the motor speed after the first signal is received by the controller, (e) after the motor speed is reduced, measuring any additional downward movement of the upper plate and measuring any increase in current or voltage drawn by the motor, followed by carrying out at least one of the two following steps:

if the additional downward movement reaches a first predetermined value, reducing the motor speed again to maintain a holding pressure, or if the current or voltage draw reaches a second predetermined value, adjusting the motor speed to maintain a holding pressure.

11. The method of claim 10 further comprising moving the upper plate past a home sensor to detect a home position prior to detecting when the upper plate engages the one or more containers.

12. The method of claim 10 wherein multiple containers are placed on the lower base, the containers each having a common height.

13. The method of claim 12 wherein the one or more containers are selected from the group consisting of five gallon cylindrical plastic pails, five gallon cylindrical metal pails, one gallon cylindrical metal pails, one gallon cylindrical plastic pails, one gallon cylindrical combination plastic/metal pails, one gallon cubically shaped plastic container with a round lid and integrated handle, one and one-half gallon cubically shaped plastic container with a round lid and integrated handle, one and one-half gallon rectangular plastic trough with rectangular lid, one gallon rectangular plastic trough with rectangular lid, one quart cylindrical metal pails, one quart cylindrical plastic pails, one quart cylindrical combination plastic/metal pails, one quart cubically shaped plastic container with a round lid and integrated handle, one quart rectangular plastic trough with rectangular lid, one pint cylindrical metal pails, one pint cylindrical plastic pails, one pint cylindrical combination plastic/metal pails, one pint cubically shaped plastic container with a round lid and integrated handle, and one pint rectangular plastic trough with rectangular lid.

14. The method of claim 10 wherein the holding pressure increases as a spacing between the lower base and upper plate increases.

15. The method of claim 10 wherein the holding pressure varies as a spacing between the lower base and upper plate varies.

16. The method of claim 10 wherein the holding pressure is different when the additional downward movement reaches a first predetermined value than when the current or voltage draw reaches a second predetermined value.

17. The method of claim 10 wherein the holding pressure is greater when the current or voltage draw reaches a second predetermined value than when the additional downward movement reaches a first predetermined value.

* * * * *